US006405439B1

(12) United States Patent
Malobabic et al.

(10) Patent No.: US 6,405,439 B1
(45) Date of Patent: Jun. 18, 2002

(54) TOOTHED CUTTER HAVING HAIR-CATCHING TEETH WITH BENT TOOTH END PORTIONS

(75) Inventors: Peter Malobabic, Klagenfurt; Roland Waldner, Pubersdorf, both of (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/514,170

(22) Filed: Feb. 28, 2000

(30) Foreign Application Priority Data

Mar. 1, 1999 (EP) ..... 99890071

(51) Int. Cl.[7] ..... B26B 19/06
(52) U.S. Cl. ..... 30/43.92; 30/346.51
(58) Field of Search ..... 30/43.9, 43.92, 30/43, 346.51

(56) References Cited

U.S. PATENT DOCUMENTS 2,298,962 A * 10/1942 Murphy ..... 30/43.92
2,345,695 A * 4/1944 Andis ..... 30/346.51
2,370,544 A * 2/1945 Jepson et al. ..... 30/346.51
3,037,280 A * 6/1962 De Paoli ..... 30/43.92
5,459,927 A * 10/1995 Kauer et al. ..... 30/346.51
5,669,138 A * 9/1997 Wetzel ..... 30/43.92

FOREIGN PATENT DOCUMENTS

JP 52-147142 7/1977 ..... B26B/19/04

* cited by examiner

*Primary Examiner*—Hwei-Siu Payer
(74) *Attorney, Agent, or Firm*—Ernestine C. Bartlett

(57) ABSTRACT

A hair-cutting apparatus (1), which preferably takes the form of a shaving apparatus, includes a toothed cutting device (10), which has a toothed cutter (13) having at least one row of hair catching teeth (14), the hair catching teeth (14) each having a non-bent first portion 18 which extends from the respective tooth base (17) and a bent second portion (20) which adjoins the first portion (18) and which extends up to the free end (19) of the respective hair catching tooth (14), a distance L existing between the bounding faces (21) of the non-bent first (?) portions (18) of the hair catching teeth (14), which bounding faces are remote from the free end portions (19) of the hair catching teeth (14), and the free end portions (19) of the hair catching teeth (14), which distance L lies in a range between 0.7 mm and 1.3 mm and preferably has a value of 1.0 mm.

16 Claims, 3 Drawing Sheets

TOOTHED CUTTER HAVING HAIR-CATCHING TEETH WITH BENT TOOTH END PORTIONS

BACKGROUND OF THE INVENTION

The invention relates to a hair-cutting apparatus having a toothed cutting device which consists of a first toothed cutter having at least one row of cutter teeth and a second toothed cutter having at least one row of hair catching teeth and in which the hair catching teeth each have a non-bent first portion which extends from a respective tooth base and a bent second portion which adjoins the first portion and extends up to the free end of the tooth, the non-bent first portions of the hair catching teeth having bounding portions which are remote from the free end portions and are separated from each other by a distance L.

The invention further relates to a hair-cutting device as described and to a toothed cutter also as described above.

The above described hair-cutting apparatus, a toothed cutting device and a toothed cutter are known from the patent document JP 52-147.142 A. In the known construction only a comparatively small distance L has been chosen, as a result of which in operation comparatively long and comparatively short hairs are caught effectively but in operation a comparatively strong skin irritation occurs owing to the comparatively small length of the bent portions of the hair catching teeth, namely as a result of scratching of the short bent tooth portions of the hair catching teeth, which gives rise to a relatively unpleasant feeling during hair-cutting and is therefore undesirable.

SUMMARY OF THE INVENTION

According to the invention, it has been found the object is, achieved when the distance L between the bounding faces lies in a range between 0.7 mm and 1.3 mm.

Owing to the measures in accordance with the invention it is achieved in a very simple manner that an effective catching of comparatively short hairs and comparatively long hairs as well as a gentle cooperation of the hair catching teeth with the skin over which they are passed is guaranteed. In the present context it is to be noted that the construction in accordance with the invention is the result of prolonged tests, during which tests it has been found that a distance L smaller than 0.7 mm—as in the case of the afore-mentioned prior-art construction—leads to a non-gentle cooperation with the skin, i.e. scratching of the skin, which results in skin irritation, which is undesirable. Furthermore, it has been found that in the case of a distance L greater than 1.3 mm a gentle cooperation of the hair catching teeth with the skin is achieved but has the disadvantage that comparatively long hairs are caught in a comparatively poor manner. Thus, the advantages mentioned hereinbefore, namely an effective catching of comparatively short hairs and comparatively long hairs as well as a gentle cooperation of the hair catching teeth with the skin, i.e. a scratch-free movement of the hair catching teeth over the skin, are guaranteed only by the provision of the feature the invention, namely that the distance L lies in a range between 0.7 mm and 1.3 mm.

It has proved to be advantageous when the distance L lies in a range between 0.9 mm and 1.1 mm and especially between 0.95 and 1.05 mm. Tests which have been carried out have shown that the values defined therein are particularly advantageous.

Furthermore, it has proved to be particularly advantageous when the nominal thickness of the hair catching teeth of the second tooth cutter, in their bent second portions, are equal to their original thickness when in an unbent condition. This is because such a construction can be manufactured in a particularly simple manner and without any additional processing.

Furthermore, it has proved to be particularly advantageous when the free ends of the hair catching.

BRIEF DESCRIPTION OF THE DRAWINGS

The invention will now be described in more detail with reference to the drawings, which shows an embodiment given by way of example but to which the invention is not limited.

DESCRIPTION OF THE PREFERRED EMBODIMENTS

Figure 1:
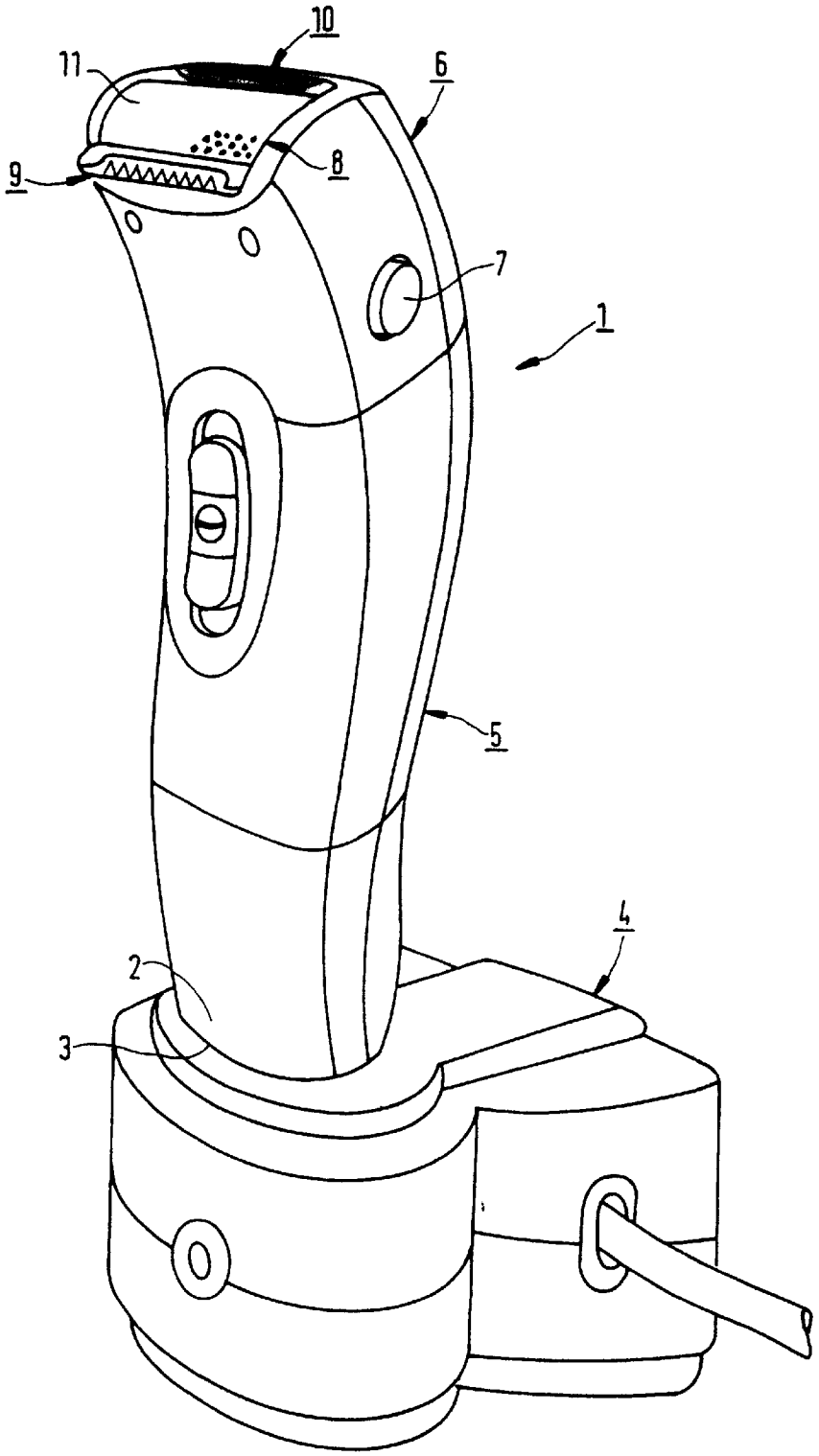
FIG. 1 is an oblique view of a hair-cutting apparatus embodying the invention, which embodiment has two toothed cutting devices.
Figure 2:
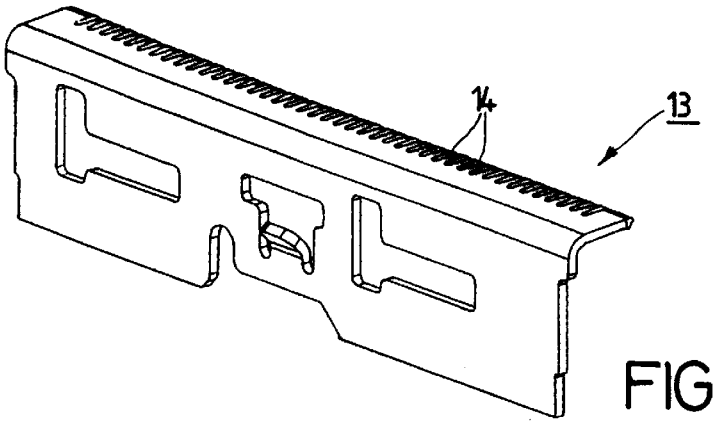
FIG. 2 is an oblique top view which shows a toothed cutter having a row of hair catching teeth of a toothed cutting device of the apparatus shown in FIG. 1.

FIG. 1 shows a hair-cutting apparatus 1 in the form of a shaving apparatus 1, which is a so-called lady shaver. With its lower end portion 2 the apparatus 1 is plugged into a receptacle 3 of a charger 4 in order to charge rechargeable batteries accommodated in the apparatus.

The apparatus 1 has a housing 5 with a gently curved shape. The housing 5 carries a shaving-head frame 6 which is detachably mounted on the housing 5 by latching devices, not shown. The shaving-head frame 6 has been provided with two push-buttons at opposite sides in order to release the latching devices, FIG. 1 showing one push-button 7, which extends through a shaving head wall.

The shaving-head frame 6 accommodates a short-hair cutting device 8 and two long-hair cutting devices 9 and 10, which are shown only diagrammatically in FIG. 1. The short-hair cutting device 8 has a foil-type upper cutter 11, which is often referred to as a shear foil. The foil-type upper cutter 11 cooperates with a drivable lower cutter, which is not shown.

The two long-hair cutting devices 9 and 10 are each formed by a respective toothed cutting device 9 or 10. Only one of the two toothed cutting devices 9 and 10, namely the toothed cutting device 10, will be described in greater detail with reference to FIGS. 2 to 5.

Figure 5:
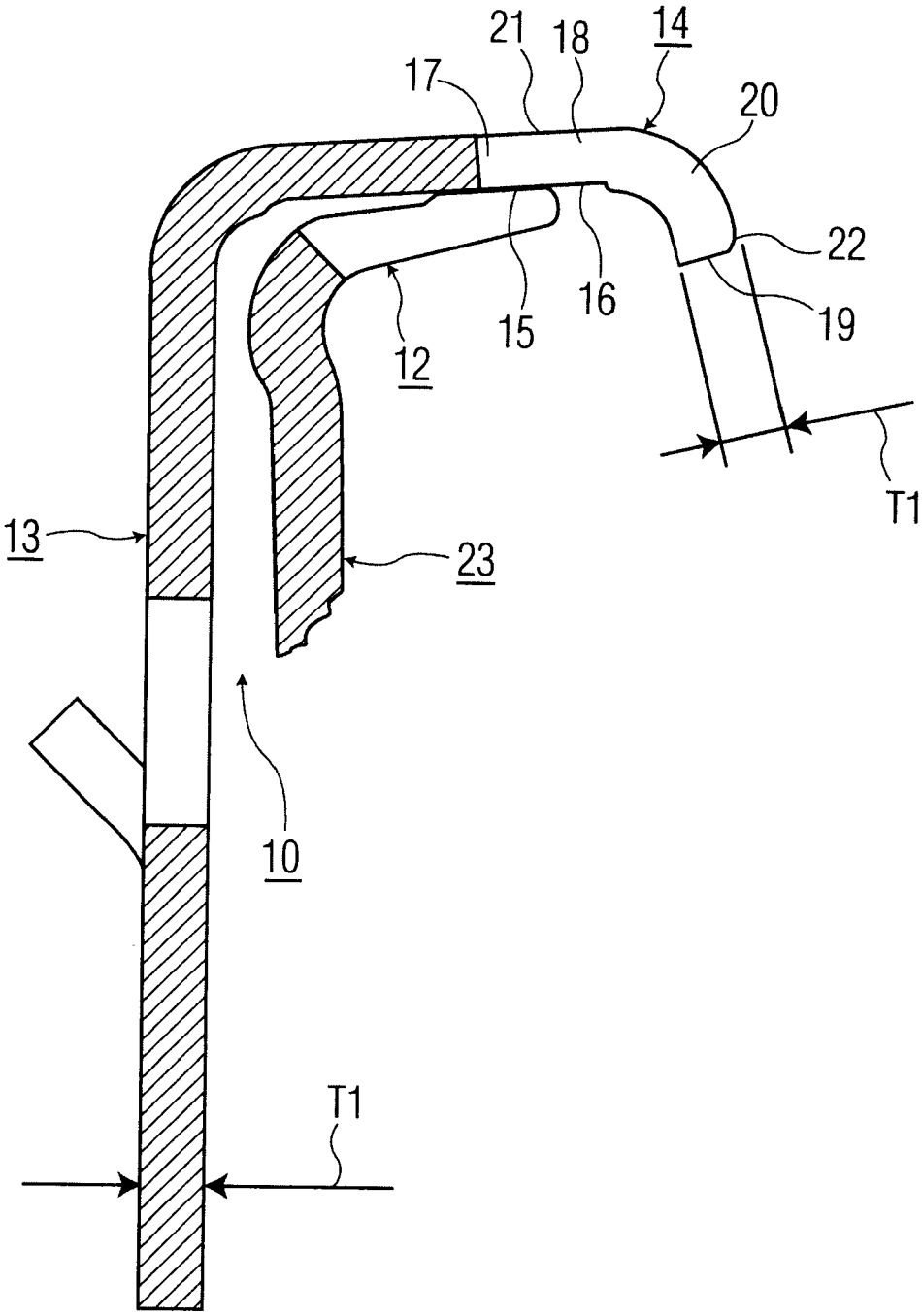
FIG. 5 is a view similar to that of FIG. 4 and shows the toothed cutter of FIGS. 2, 3 and 4 as well as a part of the toothed cutter with a row of cutter teeth, which cooperates with the first-mentioned cutter.

As can be seen in FIG. 5, the toothed cutting device 10 consists of a first toothed cutter 23 having a row of cutter teeth 12 and of a second toothed cutter 13 having a row of hair catching teeth 14. In a manner not shown, the first toothed cutter 11 is drivable so as to reciprocate in a direction which extends perpendicularly to the cutter teeth 12 and the hair catching teeth 14. The second toothed cutter is stationary. The cutter teeth 12 each have a cutting face 15 and the hair catching teeth 14 each have a cutting face 16. The cutter teeth 12 and the hair catching teeth 14 lie closely against each other with their cutting faces 15 and 16, the close engagement being guaranteed with the aid of spring means, not shown. The hair catching teeth 14 serve not only for catching hairs but, as a result of their cooperation with the cutter teeth 12, also for severing hairs.

In the toothed cutting device 10 the hair catching teeth 14 of the second toothed cutter 13 each have a non-bent first portion 18 which extends from the respective tooth base 17 and a bent second portion 20 which adjoins the first portion 18 and which extends up to the free end 19 of the respective hair catching tooth 14. The bent portion 20 has been given such a shape that a distance L exists between the bounding faces 21 of the non-bent first portions of the hair catching teeth 14, which bounding faces are remote from cutter teeth 12, and the free end portions 19 of the hair catching teeth 14.

Figure 3:
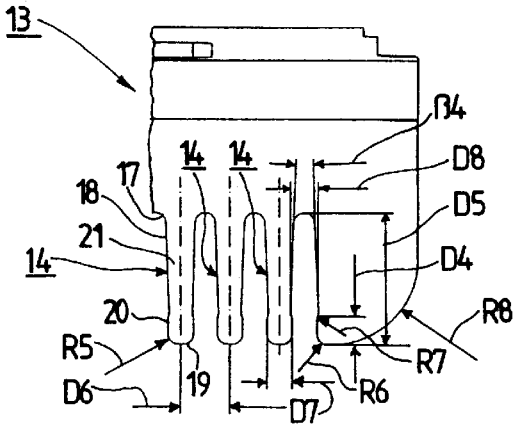
FIG. 3 is a plan view to an enlarged scale in comparison with FIG. 2 and shows a part of the toothed cutter of FIG. 2, which plan view illustrates in particular the construction of the hair catching teeth.
Figure 4:
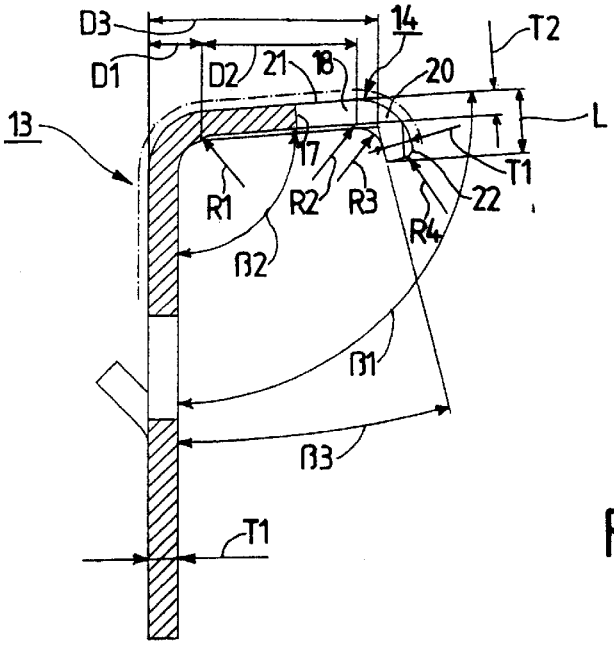
FIG. 4 is a cross-sectional view of the toothed cutter shown in FIGS. 2 and 3, the cross-sectional view being taken through a tooth gap between two hair catching teeth.

Some concrete dimensions are indicated FIGS. 3 and 4. These dimensions are specified hereinafter.

As is shown in FIG. 3, the hair catching teeth 14 are partly tapered, as a result of which two facing bounding areas of two hair catching teeth 14 enclose an angle β4 which is nominally 4°. It is to be noted that the second toothed cutter 13 has a total of forty-one (41) hair catching teeth 14. A distance D4 in FIG. 3 is nominally 0.4 mm. A distance D5 is nominally 2.0 mm. A distance D6 is nominally 0.77 mm. A distance D7 is nominally 0.39 mm. A distance D8 is nominally 0.42 mm. A radius R5 is nominally 0.15 mm. A radius R6 is also nominally 0.15 mm. A radius R7 is also nominally 0.15 mm. A radius R8 is nominally 1.3 mm.

With regard to FIG. 4 it is to be noted that a distance D1 is nominally 0.80 mm, a distance D2 is nominally 2.39 mm, a distance D3 is nominally 3.52 mm, a radius R1 and a radius R2 and a radius R4 are each nominally 0.15 mm. A radius R3 is nominally 0.40 mm. A thickness T1 is nominally 0.45 mm. A thickness T2 is nominally 0.38 mm. An angle β1 is nominally 94.0°. An angle β2 is also nominally 94.0°. An angle β3 is nominally 14.0°.

In the apparatus and in its hair cutting device 10, see also FIG. 5, the toothed cutting device 10 is constructed in such a manner that the distance L (see FIG. 4) is in a range between 0.7 mm and 1.3 mm, preferably in a range between 0.9 mm and 1.1 mm. As a matter of fact, the nominal distance L selected for the second toothed cutter 13 of the toothed cutting device 10 is 1.0 mm. In practice, this dimension has proved to be particularly advantageous. However, it is emphasized that the distance L in another variant may also be selected to be shorter than 1.0 mm, for example 0.7 mm or 0.8 mm or 0.9 mm. In a further variant the distance L may also be selected to be greater than 1.0 mm, for example 1.1 mm or 1.2 mm or 1.3 mm.

As is apparent from FIGS. 4 and 5, the nominal thickness T1 of the hair catching teeth 14 of the second toothed cutter 13 in its bent second portion 20 is equal to the original thickness T1 of the non-bent basic material. This is very advantageous in view of a simple production of the second toothed cutter 13 without any additional processing steps.

As is further apparent from FIGS. 4 and 5, the free ends 19 and thus the end portions 22, which are remote from the cutter teeth 12 and which serve for application to the skin of a user, are rounded. In the present case this rounding corresponds to the radius R4, which is nominally 0.15 mm.

Owing to the measures described hereinbefore an effective catching of comparatively short hairs and comparatively long hairs as well as a pleasant and gentle cooperation of the hair catching teeth 14 with the user's skin over which they pass is guaranteed in the apparatus 1 in accordance with the invention described hereinbefore. As regards the distance L between the bounding faces 21 of the non-bent first portions 18 of the hair catching teeth 14, which bounding faces are remote from the free end portions 19 of the hair catching teeth 14, and the free end portions 19 of the hair catching teeth 14, it is to be noted that in the advantageous range between 0.7 mm and 1.3 mm is basically independent of the thickness T1 of the bent second portion 20 of the hair catching teeth 14.

What is claimed is:

1. A hair-cutting apparatus having a toothed cutting device, which toothed cutting device consists of a first toothed cutter having at least one row of cutter teeth and of a second toothed cutter having at least one row of hair catching teeth and in which toothed cutting device the hair catching teeth of the second toothed cutter each have a non-bent first portion which extends from a respective tooth base and a bent second portion which adjoins the first portion and which extends up to a free end of the respective hair catching tooth, a distance L existing between bounding faces of the non-bent first portions of the hair catching teeth, which bounding faces are remote from the free ends of the hair catching teeth, wherein the distance L lies in a range between 0.7 mm and 1.3 mm.

2. An apparatus as claimed in claim 1, wherein the distance L lies in a range between 0.9 mm and 1.1 mm.

3. An apparatus as claimed in claim 2, wherein the distance L lies in a range between 0.95 mm and 1.05 mm.

4. An apparatus as claimed in claim 1, wherein the nominal thickness of the hair catching teeth of the second toothed cutter in its bent second portion is equal to their original thicknesses when in an unbent condition.

5. An apparatus as claimed in claim 1, wherein the free ends of the hair catching teeth, which ends are remote from the cutter teeth and which are intended for application to the skin of a user, are rounded.

6. An apparatus as claimed in claim 1, wherein the apparatus takes the form of a shaving apparatus.

7. A toothed cutting device for a hair-cutting apparatus, which toothed cutting device consists of a first toothed cutter having at least one row of cutter teeth and of a second toothed cutter having at least one row of hair catching teeth and in which toothed cutting device the hair catching teeth of the second toothed cutter each have a non-bent first portion which extends from a respective tooth base and a bent second portion which adjoins the first portion and which extends up to a free end of the respective hair catching tooth, a distance L existing between bounding faces of the non-bent first portions of the hair catching teeth, which bounding faces are remote from the free ends of the hair catching teeth wherein the distance L lies in a range between 0.7 mm and 1.3 mm.

8. The toothed cutting device as claimed in claim 7, wherein the distance L lies in a range between 0.9 mm and 1.1 mm.

9. The toothed cutting device as claimed in claim 8, wherein the distance L lies in a range between 0.95 mm and 1.05 mm.

10. The toothed cutting device as claimed in claim 7, wherein the nominal thickness of the hair catching teeth of the second toothed cutter in their bent second portions are equal to their original thickness when in an unbent condition.

11. The toothed cutting device as claimed in claim 7, wherein the free ends of the hair catching teeth, which ends are remote from the cutter teeth and which are intended for application to the skin of a user, are rounded.

12. A toothed cutter for a toothed cutting device for a hair-cutting apparatus, which toothed cutter has at least one row of hair catching teeth, which hair catching teeth of the toothed cutter each have a non-bent first portion which extends from a respective tooth base and a bent second portion which adjoins the first portion and which extends up to a free end of the respective hair catching tooth, a distance L existing between bounding faces of the non-bent first portions of the hair catching teeth, which bounding faces are remote from the free ends of the hair catching teeth, wherein the distance L lies in a range between 0.7 mm and 1.3 mm.

13. The toothed cutter as claimed in claim 12, wherein the distance L lies in a range between 0.9 mm and 1.1 mm.

14. A toothed cutter as claimed in claim 13, wherein the distance L lies in a range between 0.95 mm and 1.05 mm.

15. The toothed cutter as claimed in claim 12, wherein the nominal thicknesses of the hair catching teeth of the toothed cutter in their bent second portions are equal to their original thicknesses when in an unbent condition.

16. The toothed cutter as claimed in claim 12, Wherein the free ends of the hair catching teeth, which free ends are intended for application to the skin of a user, are rounded.

* * * * *